US006718993B1

(12) United States Patent
DeMartini

(10) Patent No.: US 6,718,993 B1
(45) Date of Patent: Apr. 13, 2004

(54) HOUSEHOLD DISHWASHER WITH VIEWABLE LEAK INDICATION DRAIN PAN

(76) Inventor: Karen L. DeMartini, 11208 Tracton La., Austin, TX (US) 78739

( * ) Notice: Subject to any disclaimer, the term of this patent is extended or adjusted under 35 U.S.C. 154(b) by 0 days.

(21) Appl. No.: 10/264,961

(22) Filed: Oct. 4, 2002

(51) Int. Cl.[7] ..... B08B 7/04

(52) U.S. Cl. ..... 134/115 R; 134/57 D; 134/56 D; 134/58 D; 134/201; 134/18; 134/25.2

(58) Field of Search ..... 134/18, 56 D, 134/57 D, 58 D, 115 R, 201

(56) References Cited

U.S. PATENT DOCUMENTS 3,519,233 A * 7/1970 Logsdon ..... 248/146
4,689,511 A * 8/1987 Baker et al. ..... 310/88
4,783,971 A * 11/1988 Alba ..... 62/291
5,645,103 A * 7/1997 Whittaker ..... 137/312
6,318,403 B1 * 11/2001 Fritz ..... 137/312
6,601,593 B2 * 8/2003 Deiss et al. ..... 134/25.2

FOREIGN PATENT DOCUMENTS

DE 24 50 075 * 5/1976 ..... 134/57 D
DE 36 44 053 * 6/1988 ..... 134/58 D

* cited by examiner

*Primary Examiner*—Zeinab El-Arini
(74) *Attorney, Agent, or Firm*—Robert C. Kowert; Meyertons, Hood, Kivlin, Kowert & Goetzel, P.C.

(57) ABSTRACT

A household dishwasher that includes a drain pan designed to relocate leaking fluids to an observable location. The dishwasher is a standard dishwasher with a drain pan for collecting water that unintentionally falls from the interior of the dishwasher. The drain pan is angled for diverting the collected water to a predetermined location exterior to the household dishwasher where an occupant of the household may view the water.

7 Claims, 4 Drawing Sheets

HOUSEHOLD DISHWASHER WITH VIEWABLE LEAK INDICATION DRAIN PAN

BACKGROUND OF THE INVENTION

1. Technical Field

The present invention relates generally to drain pans; and, more particularly, it relates to a drain pan that is designed to divert water leaking from an appliance into a location that is easily viewable.

2. Related Art

Drain pans are known to be used for various reasons such as catching or holding water that drains into an area that is not meant to get wet. Drain pans or buckets are sometimes used to catch potential unexpected fluids that are produced beneath different household appliances such as dishwashers, washing machines, showers, and sinks. For example, although conventional domestic front loading dishwashers provide a housing to protect a home from water that sprays inside the dishwasher during operation, such dishwashers typically pool a large amount of water in the bottom of the dishwasher and a crack in the bottom of the housing of the dishwasher could lead to large amounts of water unexpectedly leaving the dishwasher and spreading onto the floor of the home in which the dishwasher is installed. Also prone to failure are seals on the outside of the dishwasher housing where water is pumped into or out of the dishwasher. A broken seal may lead to a periodic flow of water from the dishwasher when, with each use of the dishwasher, water flows to an unexpected and hidden location behind kitchen counters where the water settles and causes severe damage to at least the home's structure.

Many other problems and disadvantages of the prior art will become apparent to one of ordinary skill in the art after comparing such prior art with the present invention as described herein.

SUMMARY OF THE INVENTION

Various aspects of the present inventions can be found in a household dishwasher that includes a drain pan according to principles of the present invention. The dishwasher includes a dishwasher housing for holding and washing common household dishes and utensils. Internal to the housing is a spray arm for spraying clean the dishes and utensils. To rotate the spray arm, a motor is coupled to the spray arm through the dishwasher housing. Also coupled to the spray arm through the dishwasher housing is a hose. This arrangement allows pressurized water to flow into the dishwasher housing and to spray the dishes and utensils with the spray arm. Also coupled to the household dishwasher is a drain pan for collecting water that unintentionally falls from the interior of the dishwasher. The drain pan is angled for diverting the collected water to a predetermined location exterior to the household dishwasher where an occupant of the household may view the water.

The drain pan of the dishwasher typically includes an impermeable surface that prevents water from passing through the drain pan and contacting a location beneath the drain pan. The drain pan may also include a raised perimeter to prevent water from leaving the drain pan at unintended locations. Whether the drain pan is circular or rectangular, the angling of the drain pan may be an inverted ridge that passes across the entire surface of the drain pan. Commonly, the drain pan is coupled to the dishwasher beneath the at least one hose and the at least one spray arm.

Various aspects of the present invention may also be realized through a method for detecting leaks in household appliances. The method involves installing a drain pan beneath areas of a household appliance that are prone to unexpected leaking of fluid. As stated, the drain pan is designed with a pathway to relocate fluid that comes in contact therewith. The method also involves collecting fluid in the drain pan that may leak from the appliance and associated fluid carrying tubing of the appliance, and diverting the collected fluid from the drain pan by channeling the fluid, with the aid of gravity, down the pathway of the drain pan. The drain pan is built of an impermeable material and designed to divert the collected fluid from beneath the appliance to a predetermined location that is visible to an occupant of the household.

The method may involve implementing an inverted ridge across the drain pan as the pathway of the drain pan. The inverted ridge allows the collected fluid to be directed away from the drain pan and surface beneath the household appliance. Likewise, the method may involve implementing a hose extending from the drain pan as the pathway of the drain pan. The hose allows the collected fluid to be directed away from both the drain pan and surface beneath the household appliance.

Still other aspects of the present invention are realized by a drain pan for a household appliance. The drain pan includes an impermeable surface that temporarily captures liquid that may leak from connections of the appliance. The impermeable surface has an inverted ridge that is designed to divert the captured liquid, with the assistance of gravity, to a predetermined location external to the appliance where the captured liquid becomes visible to an occupant of the household. The impermeable surface is position to have a slope that further aids in the diversion of the captured liquid to the predetermined location that is visible to the occupant of the household.

Of course, the household appliance may be a dishwasher or other appliance that might begin leaking in areas that are not generally visible. The inverted ridge of the drain pan may also cross the entire drain pan. In some embodiments, the drain pan may include a hose for diverting the captured liquid to the predetermined location. The drain pan may also include a raised perimeter for containing the captured liquid until the captured liquid is discharged to a location that is visible outside of the appliance.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

A better understanding of the present invention can be obtained when the following detailed description of various exemplary embodiments are considered in conjunction with the following drawings.

DETAILED DESCRIPTION OF THE INVENTION

For purposes of understanding principles of the drain pan of the present invention, the drain pan is described as it would be used in a common household dishwasher. Although not illustrated in detail herein, an exemplary embodiment of the dishwasher includes a wash chamber (also known as a housing) adapted to accommodate dishes, utensils, and/or other common domestic items that are soiled when preparing and consuming food in a typical household. During operation of the dishwasher, wash liquid (typically water mixed with dishwasher detergent) is circulated by a spray arm within the wash chamber at a high velocity. A well is provided in the floor of the chamber where the wash liquid is collected and drained from the chamber. An electric motor is positioned outside the chamber and includes a rotor mounted within the well and a stator mounted outside the wash chamber on the exterior surface of the well. A wash pump has an impeller that is driven by the rotor. The chamber has a liquid (sometimes referred to herein as "fluid") inlet and a liquid outlet as part of a liquid passageway to allow water or wash liquid to pass into and out of the chamber. Such liquid passageways are prone to leaking for various reasons, e.g., improper installation, defective connection seals, etc. Also problematic is damage to the chamber such as a crack. A drain pan according to principles of the present invention is introduced herein to assist in the detection of such leaking and prevent home damage from the leaking if not detected. However, the drain pan of the present invention may also be included as part of a clothes washer, hot water heater, sink, or other appliance, household or otherwise. For purposes of expediency, the formative "dishwasher" is used hereinafter when describing appliances that may implement drain pans according to various aspects of the present invention.

Figure 1:
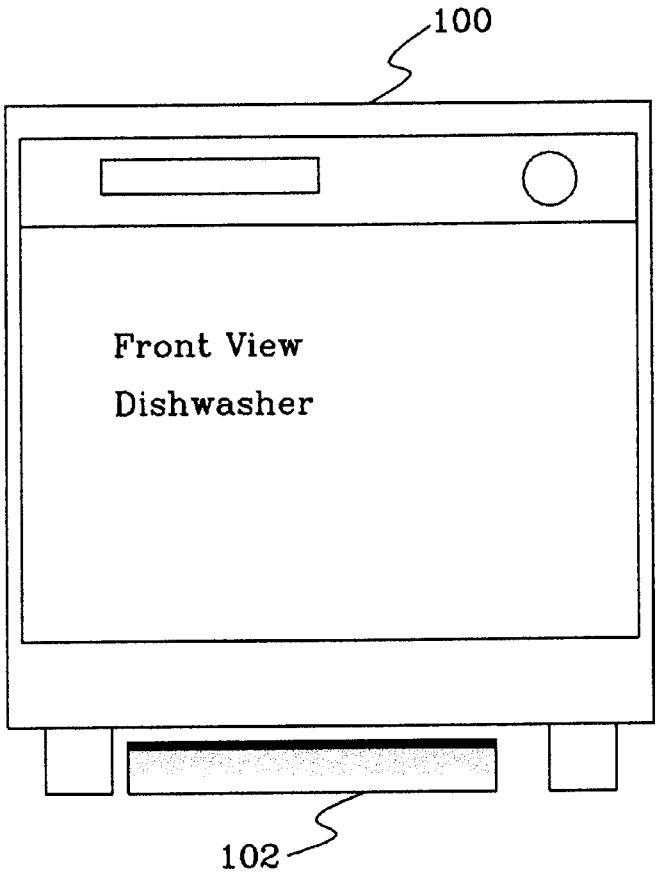
FIG. 1 is a front view of a household dishwasher and drain pan designed according to principles of the present invention.

FIG. 1 is a front view of a standard household dishwasher 100 equipped with a drain pan 102 according to principles of the present invention. The dishwasher 100 is constructed in a manner that is familiar to those of ordinary skill in the art except that the drain pan 102 is included in the structure. Although the drain pan 102 is illustrated as a rectangular pan resting beneath the dishwasher 100, it is typically mechanically coupled to the bottom of the dishwasher 100 for at least the reason that it needs to be positioned directly below portions of the dishwasher 100 that are prone to leaking. A support 106 is illustrated beneath the drain pan 102, among other things, to emphasize that the drain pan 102 is angled to disperse collected water in a particular direction. For example, the dishwasher 100 may include hoses (not shown) and seals for the hoses where water is passed inside the dishwasher 100. A defective hose or a defective seal may allow water to exit the dishwasher 100 into an unexpected area of a house. When water unexpectedly and repeatedly accumulates in certain areas of a house, severe damage may occur to the house.

The drain pan 102 is designed and positioned such that leaking water from the hoses or seals of the dishwasher 100 is captured and diverted to a location that is evident to occupants of the house. When an unexpected leak occurs in the dishwasher 100, the drain pan 102 provides a way for the occupants to detect the leak and take action to correct the defective part or replace an aging part before severe damage occurs in the house. The failure to detect leaking of this nature is sometimes a costly error that requires the remodeling of significant portions of a house because the leaking was not detected earlier. The drain pan 102 provides a way for leaking of this nature to be detected as it occurs so that severe damage to the house can be avoided.

Figure 2:
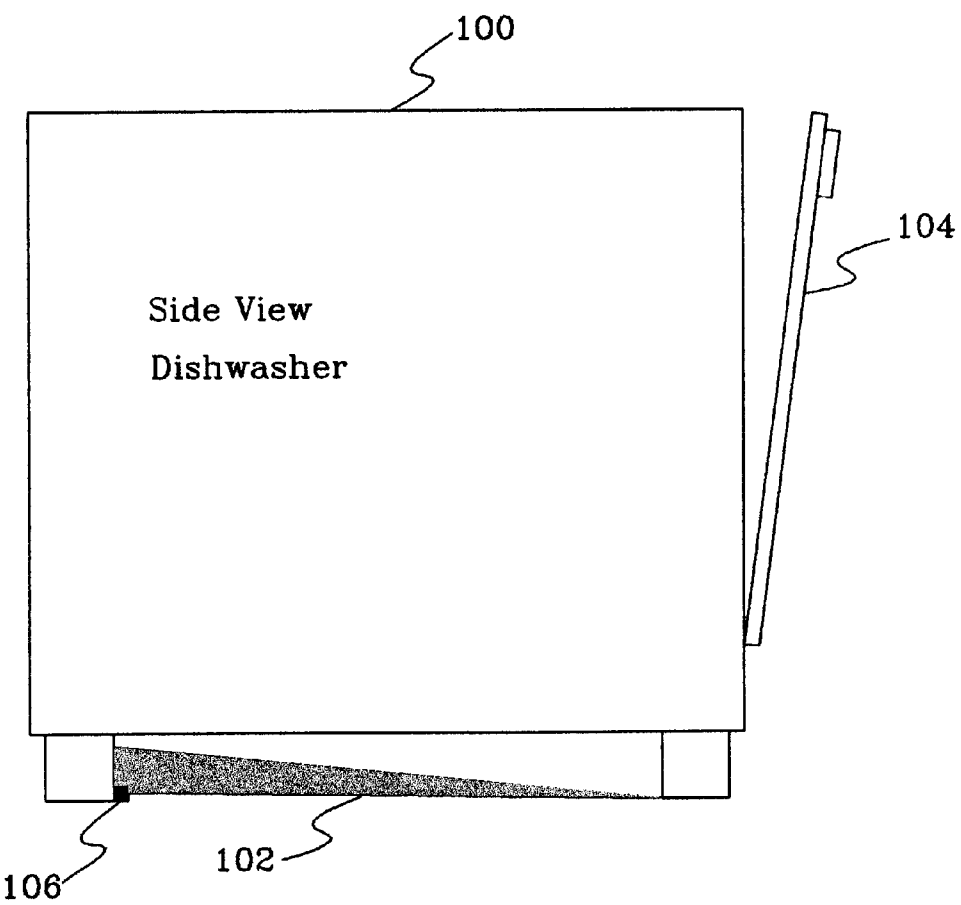
FIG. 2 is a side view of the household dishwasher of FIG. 1.

FIG. 2 is a side view of the household dishwasher 100. A door 104 to the dishwasher is illustrated as being partially opened, but, as understood by those of ordinary skill in the art, is closed during operation. The drain pan 102 is illustrated from a side view where the downward slope of the drain pan 102 may be appreciated. Water leaking from the dishwasher 100 falls to the drain pan 102 and runs toward the front of the dishwasher and onto the floor in front of the dishwasher 100 where it becomes visible to occupants of the house and corrective action may be taken before significant damage to the house occurs.

The following figures represent alternative embodiments of the drain pan 102 and are not intended to be an exhaustive list of all types of drain pans that may be used to accomplish a device according to principles of the present invention. Among other things, it is contemplated that various combinations of the illustrated embodiments, if not the illustrated embodiments themselves, may be used in a device or method of using the device.

Figure 3:
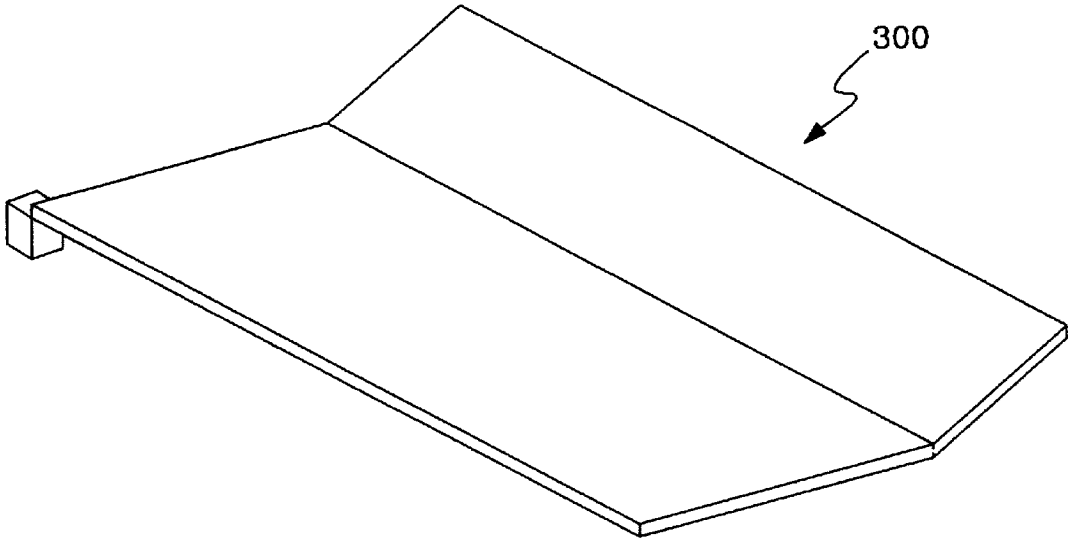
FIG. 3 is a perspective view of an exemplary embodiment of a rectangular drain pan that is built according to principles of the present invention.

FIG. 3 is a perspective view of an exemplary embodiment of a rectangular drain pan 300 that is built according to principles of the present invention. Generally speaking, the drain pan 300 is an angled sheet of impermeable material that is shaped such that liquid will flow off of the drain pan 300 to a particular location on the floor as liquids drop onto the drain pan 300. As noted above, the liquids appear due to a defective or broken part in an appliance. The drain pan 300 may be adapted to accommodate the design of various appliances, yet still divert captured liquid into an area that an occupant of a home may easily view.

Figure 4:
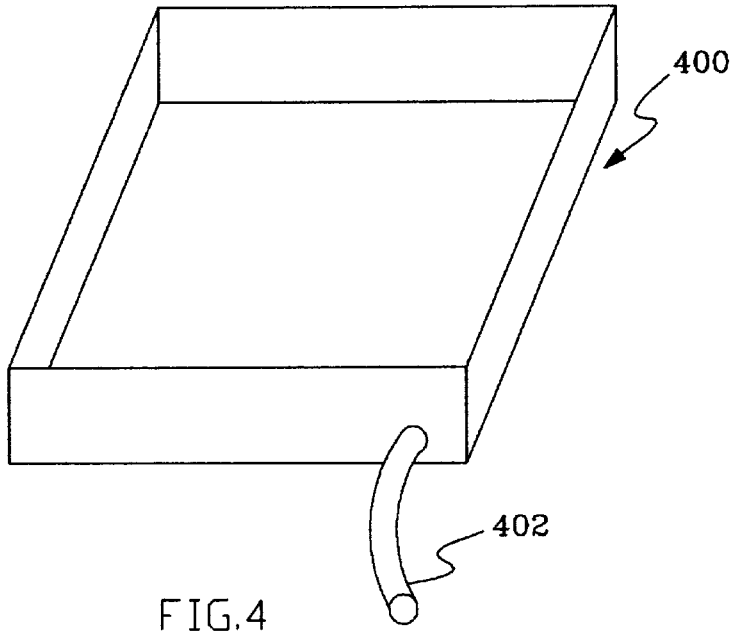
FIG. 4 is a detailed view of a drain pan and hose that is built according to principles of the present invention.

FIG. 4 is a detailed view of a drain pan 400 that is built according to principles of the present invention. The drain pan 400 includes a hose 402 that allows liquid to flow from the drain pan 400. The drain pan 400, among other things, is suited for appliances that sometimes leak in areas away from the floor. The drain pan 400 may be positioned to capture leaking fluid from such appliances and, via a hose 402, route the leaking liquid onto the floor in an area that is discoverable by a person in the vicinity of the appliance. For example, the drain pan 400 may be placed above an appliance, but below tubing that carries fluid that is meant to enter the top of the appliance. The drain pan 400 collects liquid that leaks from the tubing or its seals near the top of the appliance and routes the leaking liquid through the tube to the floor.

The drain pan 400 and hose 402 embodiment is also conducive to capturing leaking liquid from an appliance that rests behind a wall and routing the collected liquid, with the hose 402, to a viewable location on the other side of the wall.

Figure 5:
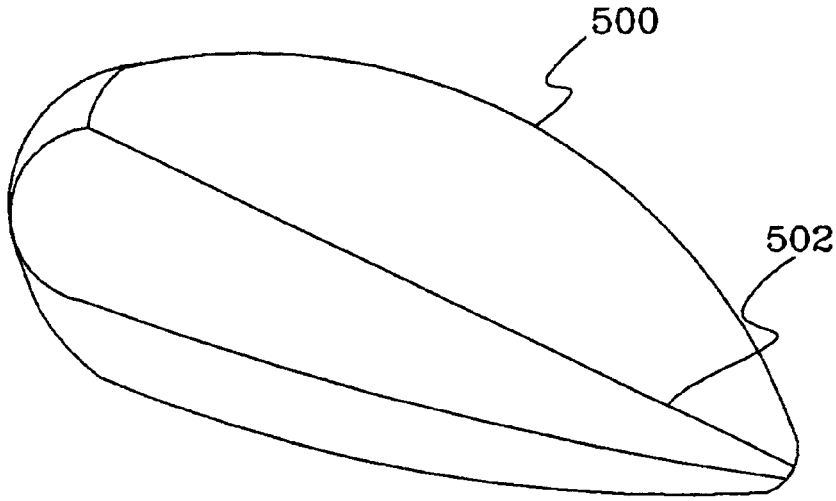
FIG. 5 is a perspective view of a circular drain pan that may be used to accomplish the advantages of the present invention in appliances having alternative shapes and body sizes.

FIG. 5 is a perspective view of a circular drain pan 500 that may be used to accomplish the advantages of the present invention in appliances having alternative shapes and body sizes. The circular drain pan 500 includes a ridge (also known as a channel or inverted ridge) 502 that channels fluid in a particular direction. Upon viewing the circular drain pan 500, those of ordinary skill in the art will understand that by "circular" is meant non-rectangular. In other words, the circular drain pan 500 could take any shape that is required for the circular drain pan 500 to fit into a position at or near an appliance where the circular drain pan 500 captures leaking fluid from the appliance and routes the fluid to a viewable area that is easily detected by a person proximate the appliance.

The ridge 502 of the circular drain pan 500 may also take various shapes. As illustrated, the ridge 502 is a straight diagonal channel across the pan 500; however, to divert fluid to a particular location, the ridge 502 may be angled differently across the pan 500. For example, the ridge 502 could turn at approximately a 90 degree angle midway down the pan 500 so that fluid is diverted to the desired location away from the appliance.

Figure 6:
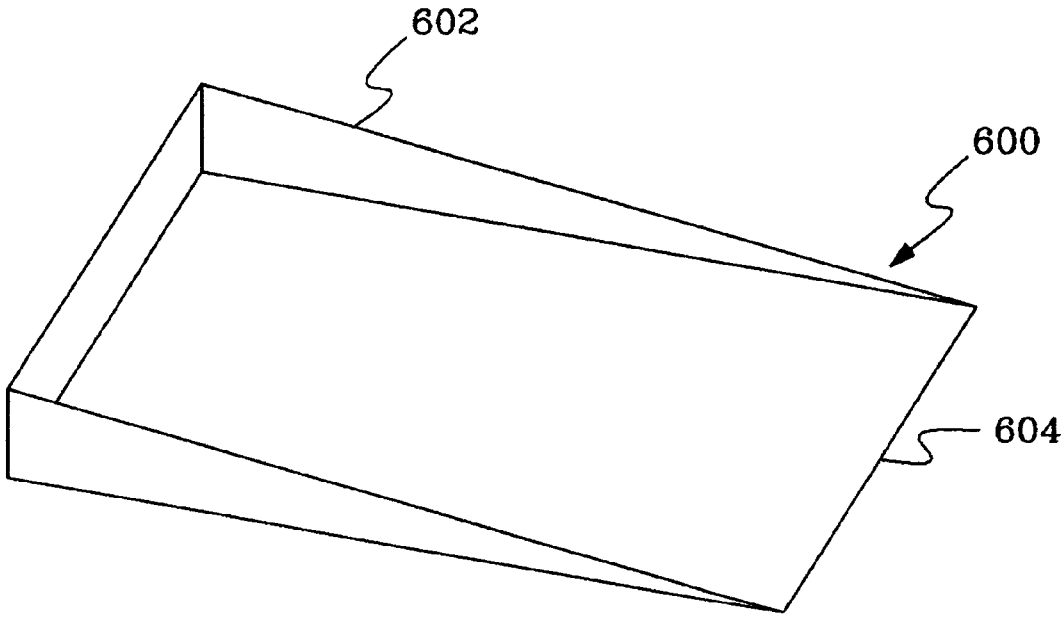
FIG. 6 is a perspective view of a drain pan having a raised perimeter.

FIG. 6 is a perspective view of a drain pan 600 having a raised perimeter 602. The raised perimeter 602 is essentially a wall that prevents fluid from leaving the drain pan 600 unless the fluid has traveled to an unblocked end 604 of the pan where the fluid makes contact with a predetermined location outside of the pan 600. Of course, the raised perimeter 602 typically covers three of the four sides of the pan 600 and if the pan 600 were circular or otherwise shaped, the raised perimeter 602 would cover portions of the pan 600 where fluid should not pass to leave the pan 600.

Figure 7:
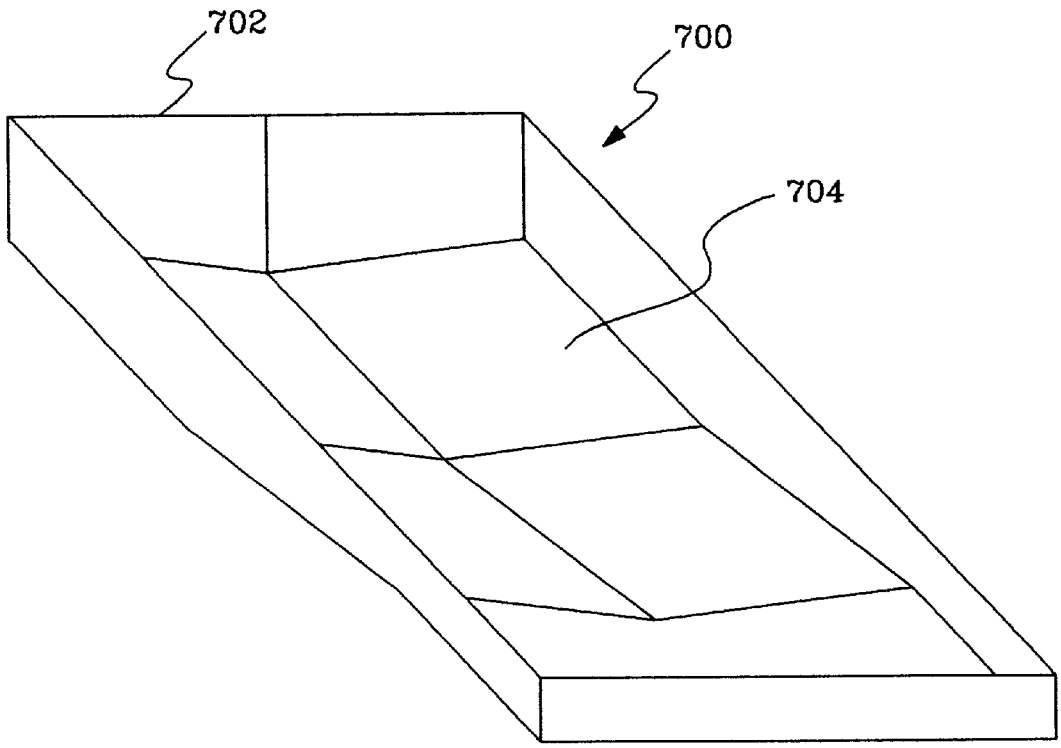
FIG. 7 illustrates a perspective view of a drain pan designed to hold up to a certain amount of fluid prior to diverting the fluid to a particular predetermined location.

FIG. 7 illustrates a perspective view of a drain pan 700 designed to hold up to a certain amount of fluid prior to diverting the fluid to a particular predetermined location. The drain pan 700 includes a raised perimeter 702 bordering a multi-angled floor 704 of the drain pan 700. In the illustrated embodiment, the multi-angled floor 704 is designed to pool fluid until the fluid reaches the depth of the raised perimeter 702, at which point, the fluid flows over the edge of the drain pan 700. The drain pan 700 and multi-angled floor 704 are angled such that the overflowing fluid occurs only on the desired edge of the drain pan 700.

Because the above detailed description is exemplary, when "one embodiment" is described, it is an exemplary embodiment. Accordingly, the use of the word "one" in this context is not intended to indicate that one and only one embodiment may have a described feature. Rather, many other embodiments may, and often do, have the described feature of the exemplary "one embodiment." As used above, when the invention is described in the context of one embodiment, that one embodiment is one of many possible embodiments of the invention.

Notwithstanding the above caveat regarding the use of the words "one embodiment" in the detailed description, it will be understood by those within the art that if a specific number of an introduced claim element is intended, such an intent will be explicitly recited in the claim, and in the absence of such recitation no such limitation is present or intended. For example, in the claims below, when a claim element is described as having "one" feature, it is intended that that element be limited to one and only one of the feature described. Furthermore, when a claim element is described in the claims below as including or comprising "a" feature, it is not intended that the element be limited to one and only one of the feature described. Rather, for example, the claim including "a" feature reads upon an apparatus or method including one or more of the feature in question. That is, because the apparatus or method in question includes a feature, the claim reads on the apparatus or method regardless of whether the apparatus or method includes another such similar feature. This use of the word "a" as a nonlimiting, introductory article to a feature of a claim is adopted herein as being identical to the interpretation adopted by many courts in the past, notwithstanding any anomalous or precedential case law to the contrary that may be found. Similarly, when a claim element is described in the claims below as including or comprising an aforementioned feature (e.g., "the" feature), it is intended that that element not be limited to one and only one of the feature described. Furthermore, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

While particular embodiments of the present invention have been shown and described, based upon the teachings herein, various modifications, alternative constructions, and equivalents may be used without departing from the invention claimed herein. Consequently, the appended claims encompass within their scope all such changes, modifications, etc. as are within the true spirit and scope of the invention. Furthermore, it is to be understood that the invention is solely defined by the appended claims. The above description is not intended to present an exhaustive list of embodiments of the invention. Unless expressly stated otherwise, each example presented herein is a nonlimiting or nonexclusive example, whether or not the terms nonlimiting, nonexclusive or similar terms are contemporaneously expressed with each example. Although an attempt has been made to outline some exemplary embodiments and exemplary variations thereto, other embodiments and/or variations are within the scope of the invention as defined in the claims below.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A household dishwasher comprising:

a dishwasher housing for holding and washing common household dishes and utensils;

at least one spray arm disposed internal to the dishwasher housing for spraying clean the dishes and utensils;

a motor mechanically coupled to the at least one spray arm through the dishwasher housing for rotational purposes;

at least one hose being coupled to the at least one spray arm through the dishwasher housing such that pressurized water flows into the dishwasher housing to accomplish the spraying of the dishes and utensils with the at least one spray arm; and a drain pan coupled to the household dishwasher for collecting water that unintentionally falls from the interior of the household dishwasher, the drain pan being angled for diverting the collected water to a predetermined location exterior to the household dishwasher where the water is visible to the occupant of the household.

2. The household dishwasher of claim 1 wherein the drain pan comprises an impermeable surface that prevents water from passing through and contacting a location beneath the drain pan.

3. The household dishwasher of claim 1 wherein the drain pain includes a raised perimeter that prevents water from leaving the drain pan at unintended locations.

4. The household dishwasher of claim 1 wherein the angling of the drain pan comprises an inverted ridge that passes across the entire drain pan.

5. The household dishwasher of claim 4 wherein the drain pan comprises a circular impermeable surface with the inverted ridge crossing the diameter of the drain pan.

6. The household dishwasher of claim 4 wherein the drain pan comprises a rectangular impermeable surface with the inverted ridge crossing the length of the drain pan.

7. The household dishwasher of claim 1 wherein the drain pan is mechanically coupled to the dishwasher beneath the at least one hose and the at least one spray arm.

* * * * *